US010573995B2

(12) United States Patent
Lehmann et al.

(10) Patent No.: US 10,573,995 B2
(45) Date of Patent: Feb. 25, 2020

(54) CONNECTOR ASSEMBLY WITH DUAL SECONDARY LOCK

(71) Applicant: Aptiv Technologies Limited, St. Michael (BB)

(72) Inventors: Rene Lehmann, Fuerth (DE); Vincent Regnier, Spardorf (DE); Bartlomiej Siwek, Cracow (PL)

(73) Assignee: Aptiv Technologies Limited (BB)

( * ) Notice: Subject to any disclaimer, the term of this patent is extended or adjusted under 35 U.S.C. 154(b) by 79 days.

(21) Appl. No.: 15/784,748

(22) Filed: Oct. 16, 2017

(65) Prior Publication Data

US 2018/0109035 A1 Apr. 19, 2018

(30) Foreign Application Priority Data

Oct. 19, 2016 (EP) ..... 16194695

(51) Int. Cl.

| | |
|---|---|
| ***H01R 13/639*** | (2006.01) |
| ***H01R 13/516*** | (2006.01) |
| ***H01R 13/627*** | (2006.01) |
| ***H01R 13/635*** | (2006.01) |

(52) U.S. Cl.

CPC ..... *H01R 13/639* (2013.01); *H01R 13/516* (2013.01); *H01R 13/6273* (2013.01); *H01R 13/635* (2013.01); *H01R 2201/26* (2013.01)

(58) Field of Classification Search

CPC ..... H01R 13/6273; H01R 13/639
USPC ..... 439/352
See application file for complete search history.

(56) References Cited

U.S. PATENT DOCUMENTS

| | | | | |
|---|---|---|---|---|
| 6,341,972 | B1 * | 1/2002 | Odorfer | H01R 13/582 439/352 |
| 6,699,059 | B2 * | 3/2004 | Nagamine | H01R 13/6273 439/188 |
| 6,964,579 | B2 * | 11/2005 | Seminara | F42B 3/26 439/188 |
| 7,121,867 | B2 * | 10/2006 | Annecke | H01R 13/6273 439/352 |

(Continued)

FOREIGN PATENT DOCUMENTS

| | | | |
|---|---|---|---|
| CN | 105531866 | A | 4/2016 |
| EP | 2840664 | A1 | 2/2015 |
| EP | 2966735 | A1 | 1/2016 |

*Primary Examiner* — Tulsidas C Patel
*Assistant Examiner* — Marcus E Harcum
(74) *Attorney, Agent, or Firm* — Robert J. Myers

(57) ABSTRACT

A connector assembly including a connector housing having a plug-in portion and two primary latching arms arranged on opposite sides of the plug-in portion. Secondary locking means are connected to the connector housing and movable relative to the connector housing from an open position to a locked position. The locking means includes blocking arms configured to block a release movement of the latching arms when the locking means is in its locked position. The secondary locking means has two separate locking members each of which is connected to one of the primary latching arms to block a release movement of the assigned latching arm. Each of the two separate locking members is configured to be independently moveable between the open position and the locked position. Each locking member comprise actuating release handles to allow an un-latching of the actuating arms. The release handles are arranged adjacent to each other.

12 Claims, 8 Drawing Sheets

(56) References Cited

U.S. PATENT DOCUMENTS

| | | | | |
|---|---|---|---|---|
| 7,238,039 | B2 * | 7/2007 | Holweg | H01R 13/6273 439/352 |
| 8,968,021 | B1 | 1/2015 | Kennedy et al. | |
| 9,017,090 | B2 * | 4/2015 | Matsumoto | H01R 13/6275 439/350 |
| 9,409,536 | B2 * | 8/2016 | Gunreben | B60R 21/16 |
| 9,929,503 | B2 * | 3/2018 | Gunreben | H01R 13/6273 |
| 2014/0106601 | A1 * | 4/2014 | Matsumoto | H01R 13/639 439/352 |
| 2015/0056841 | A1 * | 2/2015 | Siwek | H01R 13/6273 439/352 |
| 2016/0082859 | A1 | 3/2016 | Yang et al. | |

* cited by examiner

CONNECTOR ASSEMBLY WITH DUAL SECONDARY LOCK

CROSS-REFERENCE TO RELATED APPLICATION

This application claims the benefit under 35 U.S.C. § 119(a) of Patent Application No. 16194695.9 filed in the European Patent Office on Oct. 19, 2016, the entire disclosure of which is hereby incorporated by reference.

TECHNICAL FIELD OF THE INVENTION

The present invention relates to a connector assembly, in particular for airbag restraint systems. The connector assembly comprises a connector housing and secondary locking means. The connector further has release means to unlock a locked connector. The release means are housed in a retraced area of the connector.

BACKGROUND OF THE INVENTION

In many applications, the safe coupling of connectors is of high importance. For example, in the case of car safety systems, as e.g. airbag systems in passenger cars, the connectors used for the connection of an airbag to its ignition base have to be provided with reliable safety systems. To ensure that the connectors cannot become loose unintentionally, secondary locking means are used in addition to the primary locking means to guarantee a safe mechanical coupling.

An example of a connector with a secondary locking means is described in European Patent Application No. 2966735. This document discloses a connector which can be mated with a corresponding counter connector being part of an airbag ignition mechanism. In assembled condition, (i.e. the connector is mated with the corresponding counter connector), the connector is fixed to the counter connector by means of flexible latching arms. During mating of the connectors, these arms are deflected and snap back into corresponding latching clearances of the counter connector, when fully mated. The connector has a secondary locking device and a safety spring element, which serves to hold the secondary locking means in a position, in which the secondary locking means is mounted to the connector housing so that it does not hinder mating or un-mating of the connector with a corresponding counter connector. Once the locking arms are inserted, they inhibit bending of the latching arms out of the corresponding latching clearances. Thus, the mechanical coupling of the connectors is secured.

Hereby the secondary locking means is movable between a first and a second position. When placed in its second position, it serves to secure the mating of the connector housing to a corresponding counter connector. During mating, the spring is biased to cause the secondary lock to move automatically into a locked position when the connector assembly is fully mated with is corresponding counter connector, without need for an operator to push the secondary locking means into the locked position.

The secondary locking means has protrusions that protrude on opposite sides out of the connector housing. The protrusions require elongated openings to allow movement of the protrusions. This protrusions. work as handles to unlock the connector by an operator in case the connector has to be released for service or repair. While connecting to the counter connector the handles are moved contrary to the mating direction by the counter connector. They move until the connector is in the final position and then snap back to their inactive position. To unlock the connector the handles have to be pulled contrary to the mating direction. This movement has to be applied on both handles at the same time. While assemble the connector to a counter connector or an electronic unit in a narrow installation space, problems with the handles can pop up. Electrical wires or other parts can move accidentally between a handle and the counter connector and disturb this way a proper movement of the secondary locking means. This can lead to an only partially mated connection. If the connector is only partially mated, it might occur that the connector assembly electrically functions correctly, since the electrical contacts of the connector and the corresponding counter connector are connected (i.e. current conduction is possible), but the mechanical connection is not according to the desired specification. Furthermore dirt and even metal parts can move to the inside of the connector by the elongated openings for the secondary locking means.

Therefore, in one aspect, the present invention improves the state of the art by providing a connector assembly with an improved secondary locking mechanism. Furthermore present invention reduces also the production costs of the connector assembly.

These and other objects which become apparent upon reading the following description are solved by a connector assembly according to independent claim 1.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

The present application relates to a connector assembly, in particular for airbag restraint systems. The connector assembly comprises a connector housing and secondary locking means (i.e. a secondary lock).

Generally preferred, the connector housing comprising a plug-in portion and two primary latching arms, arranged on opposite sides of the plug-in portion. A secondary locking means, assigned to the connector housing and arranged relatively movable to the connector housing from an open position to a locked position, said locking means comprise blocking portions that are configured to block a release movement of the latching arms when the locking means is in its locked position. The secondary locking means comprises two separate locking members and each of the two separate locking members is assigned to one of the primary latching arms to block a release movement of the assigned latching arm and each of the two separate locking members is configured to be independently moveable between the open position and the locked position. Each locking member comprises an actuating release handle to allow an unlatching of the actuating arm, wherein the release handles are arranged adjacent to each other.

According to a preferred embodiment, the connector assembly is further comprising a cover that, at least partly, surrounding the secondary locking means around a mating axis. The cover has at least one, in mating direction elongated, opening and wherein a portion of the secondary locking means closes the opening in the open position and the locked position. The elongated opening is nearly always covert by a portion of the secondary locking means. The opening is not covert in the moment of connecting or disconnecting the connector. These moments are usually only fractions of a second. Due this the possibility that dirt or particles enter the connector is nearly impossible.

Preferably, the cover comprises an outer surface and a channel. The channel extends from the outer surface inwards to the cover and along the mating axis. The at least one elongated opening is located in the channel. The position of the opening in the channel protects the connector furthermore from being penetrated by dirt or particles because the elongated opening is backspaced from the cover surface.

Advantageously, the release handles are fully received in the channel. The release handles doesn't protrude out of the connector body. Due that it's nearly impossible that an electrical wire hinder the release handles in their movement. Furthermore such a release handles arrangement allows to engage a tool to the release handle to release the connector from the counter connector, while the operating tool doesn't protrude out of the connector body. Due that engaging tool doesn't required extra packaging space for connector service.

In a preferred embodiment, the channel comprises two channel walls opposed to each other and spaced apart from each other, extending perpendicular from the outer surface towards the cover. A bottom wall connects the two channel walls. This kind of geometry makes it easy to produce the cover for the connector e.g. by injection molding.

Preferably, the elongated opening starts on the end of the cover that is adjacent to the plug-in portion of the connector and extends contrary to a mating direction. The elongated opening has a slit shaped form beginning on the end of the cover. This makes it possible to design the cover shaped. The cover can be put on the preassembled locking members whereby parts of the locking members slide through the slit.

According to a preferred embodiment the locking members are identical to each other. Making the locking members identical read uses production costs and a high amount. If the locking members are made of plastics, the locking members can be produced with only one tool on an injection molding machine.

In a preferred embodiment, the locking member has an elongated body, extending along the mating axis. An elongated body makes it possible to guide the body very precise in the connector housing.

Advantageously, the locking member comprises a block spring shaft that protrudes perpendicular to the mating axis and wherein a center axis of the block spring shaft and the mating axis of the connector define a mirror plane. Each locking member is mirror symmetrical to the mirror plane. This design makes it impossible to position the locking member in a wrong way, while assembling it to the connector. The locking member is usable in each possible position.

Preferably, a first wall extends perpendicular from the elongated body along the mating axis. A second wall extends perpendicular and along the mating axis from a portion of a free end of the first wall. The first wall defines the cover for the elongated opening by covering the opening on the inside of the cover. The second wall protrudes through the opening in the cover. The second wall also defines a part of the handle.

According to a preferred embodiment a third wall extends perpendicular and along the mating axis from a portion of a free end of the second wall. The third wall enlarges the release handles and makes them more robust.

In a preferred embodiment, the first wall and/or the second wall comprise sloped portions that are sloped relative to the mating axis. The walls increase in size along mating direction. Thanks to the sloped portions a release tool moved from the backside of the connector, where wires enter the connector, can be guided to the release handles. The tool is guided in the channel towards the counter connector. The sloped portions guide the tool over an edge of the release handles until the tool locks on the release handles.

Advantageously, a free end of the second wall and/or a free end of the third wall, facing toward the counter connector, defines the release handle. The release handle has a flat surface that faces the counter connector. This makes it possible to engage a tool to the release handle to release the connector from the counter connector.

Preferably, the length of the first wall along the mating axis is configured to cover the openings. The first wall can be designed as needed to cover the elongated opening in the cover. This gets more freedom in design of the connector.

According to a preferred embodiment the locking member comprises at least two guiding protrusions and the cover comprises guiding areas on inner walls of the cover to guide the locking member while mating to the counter connector. The double guiding protrusions, with the coil spring in between, provide a very precise and strong guiding.

Therefore, in one aspect, the present invention improves the state of the art by providing a connector assembly with an improved secondary locking mechanism. Furthermore present invention reduces also the production costs of the connector assembly.

Further features and advantages will appear more clearly on a reading of the following detailed description of the preferred embodiment, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
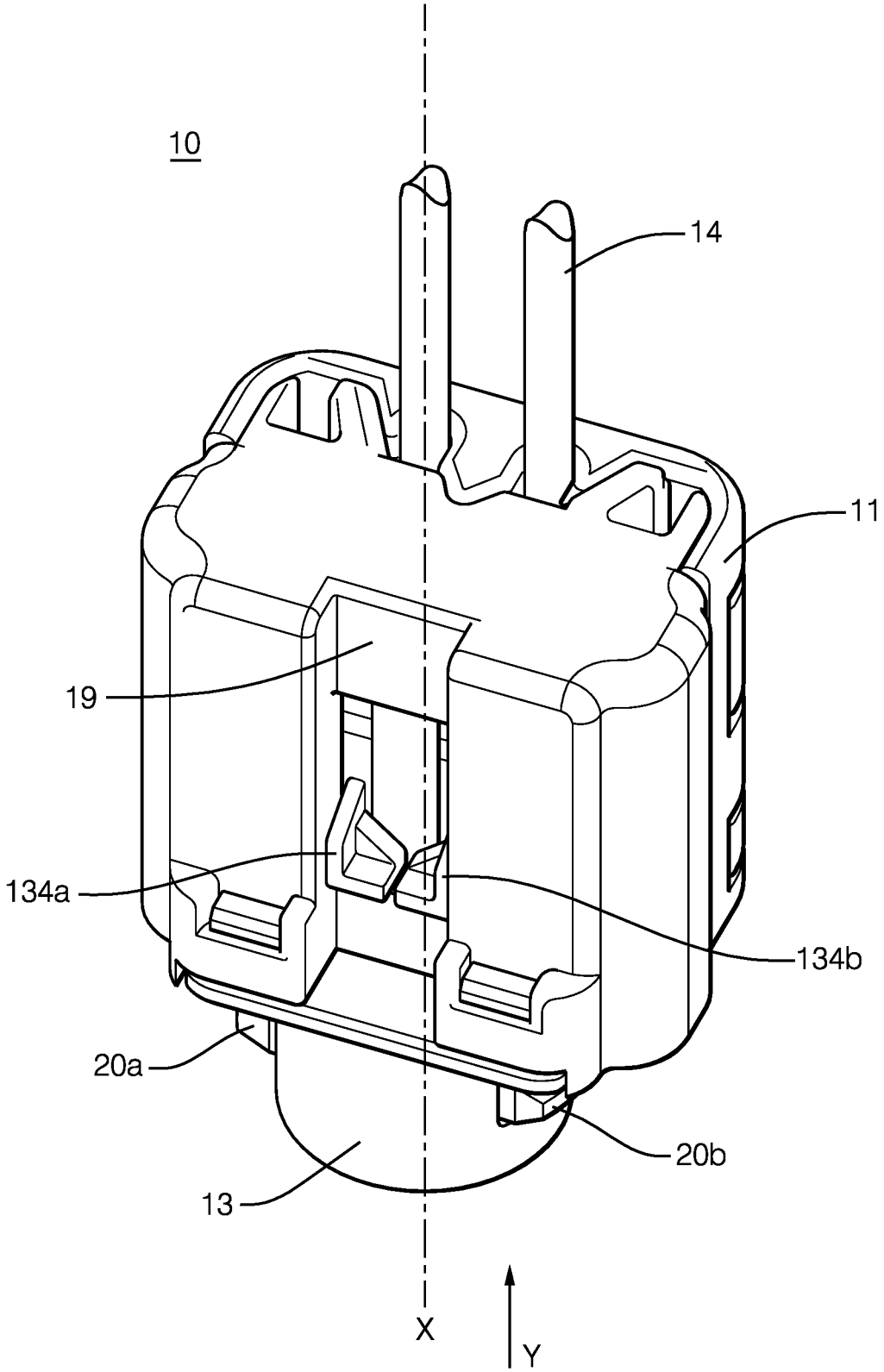
FIG. 1 is a perspective view of a connector comprising two separate release handles in accordance with the present invention according to an embodiment of the invention.

A non-limiting example of a connector 10 suitable for use in a motor vehicle is illustrated in FIG. 1. The connector housing comprises a main body 12 and a cover 11 which is removable latched to the main body 12 by means of latch connections. At the top side of the cover 11 electrical wires 14 fed through the cover 11. At the bottom side of the main body 12 a cylindrical plug-in portion 13 is provided. The skilled person will recognize, that the plug-in portion 13 is configured to cooperate with typical airbag squib sockets and that the device shown is thus an airbag squib connector. On opposite sides of the plug-in portion 13, two latching arms 20*a*, 20*b* are arranged. In other words, the two latching arms 20*a*, 20*b* are arranged symmetrically on opposite sides of the plugging portion 13. The latching arms provide the primary locking of the connector. The cover 11 comprising a slot 17 in an outer surface 11*b* wherein the slot 17 extends from the outer surface 11*b* inwards to the cover 11 and along a mating axis X, defining a channel 18, wherein two elongated openings 16 are located in the channel 18. Two actuating release handles 134*a*, 134*b* are located inside the channel 18.

Figure 2:
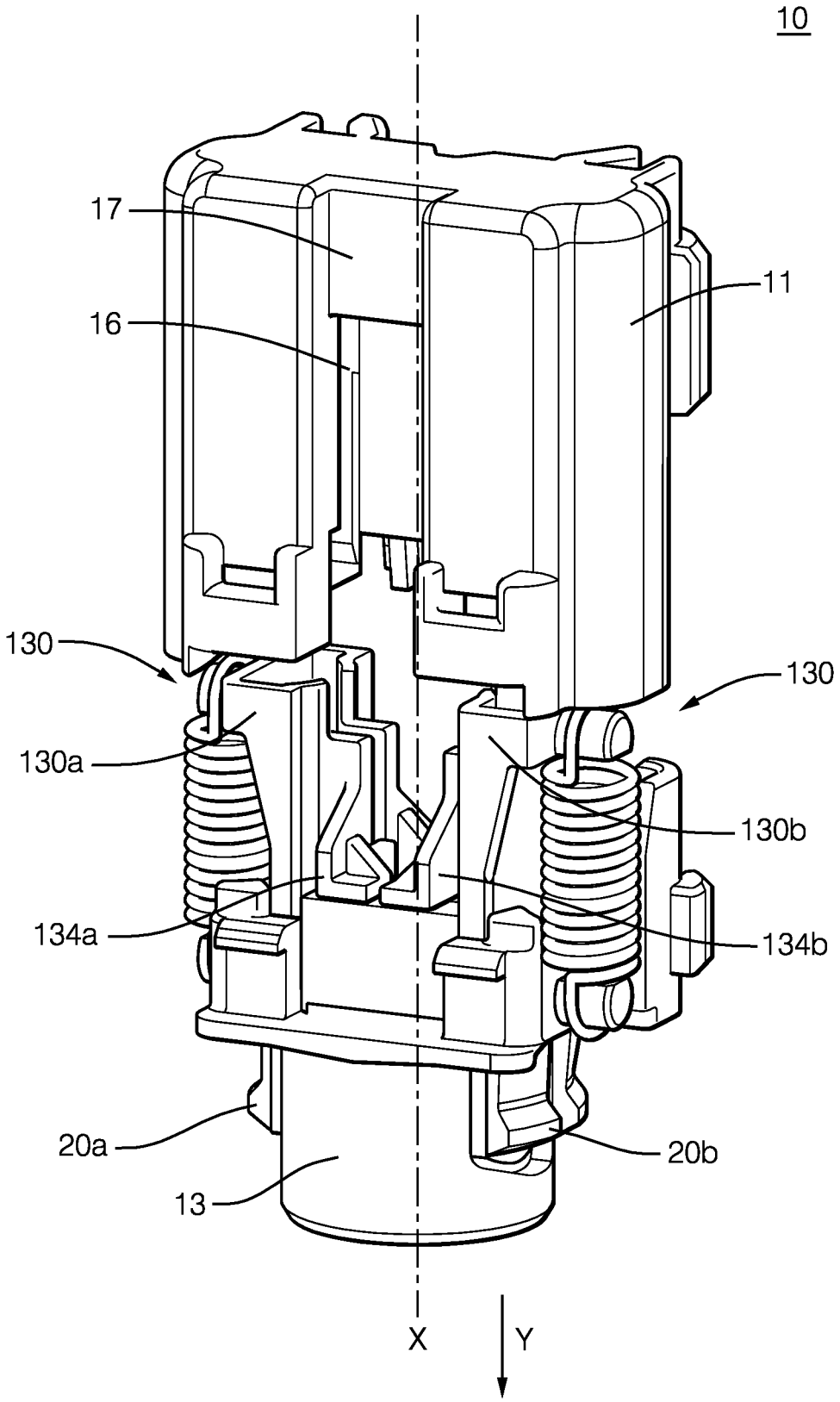
FIG. 2 is a perspective view of the connector of FIG. 1 wherein the cover is removed to show the inner parts according to an embodiment of the invention.

FIG. 2 shows the same device whereby the cover 11 is removed to allow a view of the interior construction of the connector. Indicated by the reference number 130, a secondary locking means is arranged moveable inside of the main body 12 of the connector housing 10. Secondary locking means 130 is shown in its locked position and consists of two distinct locking members 130*a* and 130*b*. When coupled or mated to a corresponding counter connector, the secondary locking means 130 will prevent an unintentional un-mating of the two connector parts, when in the position shown in FIG. 1. The skilled person will find in EP2966735 detailed information about how the connector interacts with the retainer of an airbag. In the open view of FIG. 2 one can see two coil springs 40*a*, 40*b* aligned along the mating axis X. The springs 40*a*, 40*b* each comprises two hook shaped end portions that are operationally connected to a locking member 130*a*, 130*b* on one end and to the main body 12 on the other end. Each locking member 130*a*, 130*b* provides a block spring shaft 138*a*, 138*b* and the main body 12 provides two body spring shafts 15*a*, 15*b*. The spring force urges the parts towards each other by pulling on the shafts. The locking members 130*a*, 130*b* are urged towards the main body 12 in mating direction Y. As can be seen the springs 40*a*, 40*b* are tensioned when the locking members 130*a*, 130*b* are in their open position. Upon mating, the springs 40*a*, 40*b* will automatically move the locking members 130*a*, 130*b* in the locked position. It is clear for the skilled person, that the shown springs 40*a*, 40*b* are only one example and that it is possible to use also other constructions without deviating from the core idea thereof.

Figure 3:
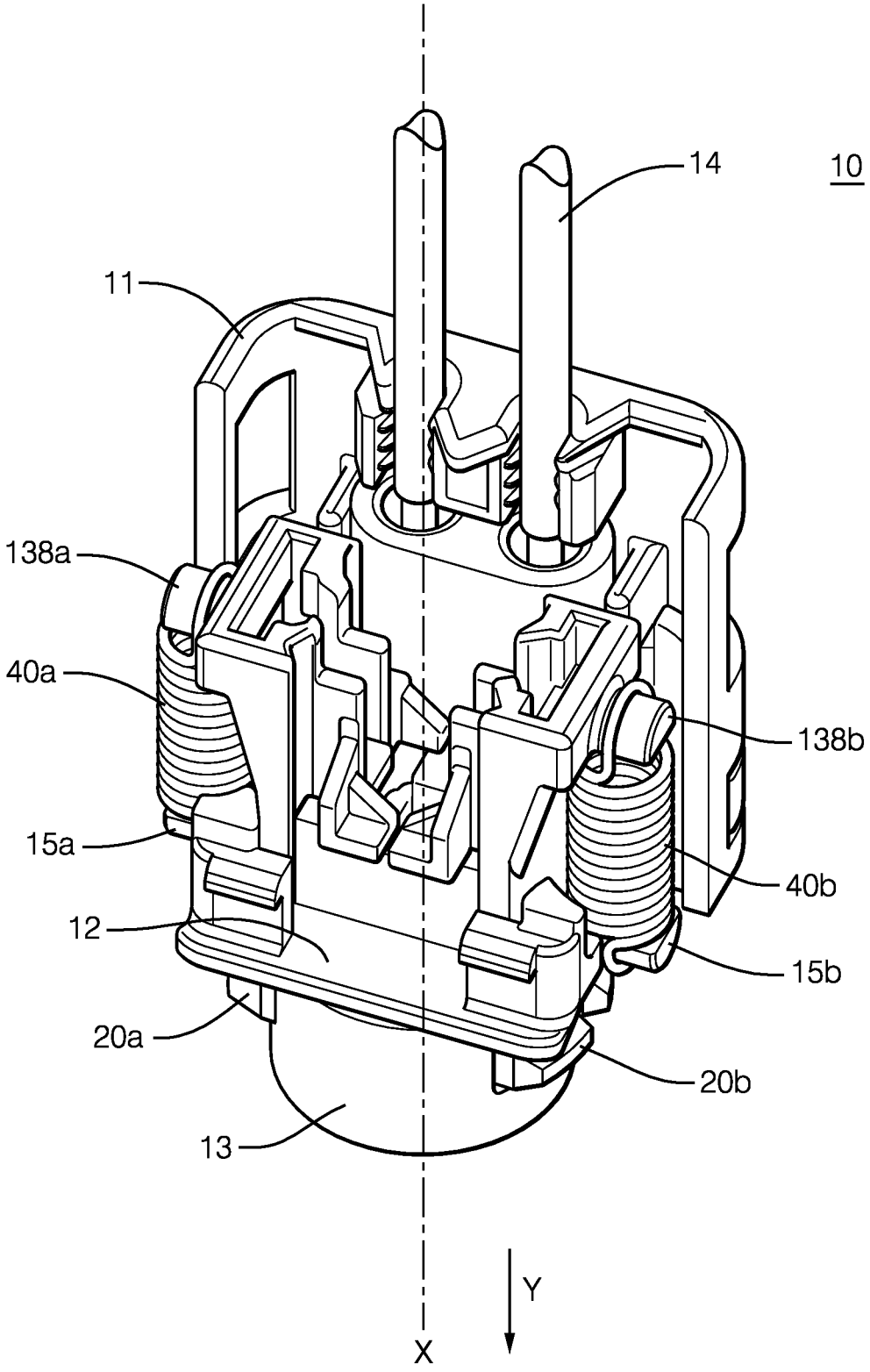
FIG. 3 is a perspective view of the connector of FIG. 1 wherein the cover is partly removed to show the inner parts and the arrangement of the cover according to an embodiment of the invention.

FIG. 3 shows a perspective view of a connector. The channel 18 in the cover 11 is defined by a slot 17 in an outer surface 11*b* of the cover 11. The channel 18 has two channel walls 18*a*, 18*b* and a channel bottom wall 18*c*. In the bottom wall 18*c* are two openings 16. For better visibility only one locking member 130*a* is assembled in the connector. The position where a second locking member 130*b* usually is located, shows an empty opening 16. The openings 16 are in this embodiment elongated slits. The part of the locking member 130*a* that defines the release handle 134*a* is located inside the channel 18. The release handle 134*a* is connected to the remaining locking member 130*a* by a portion that passes through the opening 16.

Figure 4:
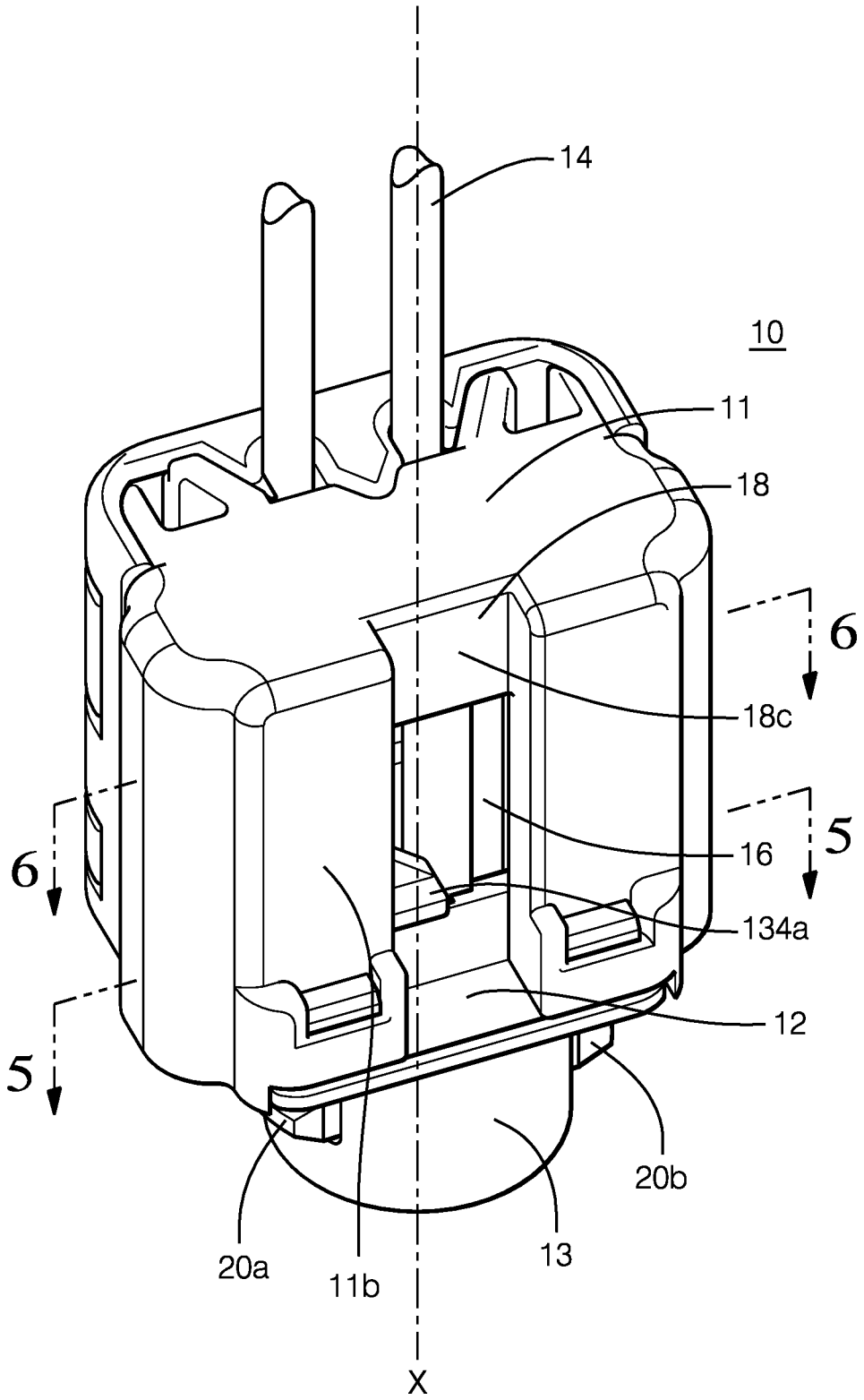
FIG. 4 is a perspective view of the connector of FIG. 1 wherein one of locking members is the removed to show the opening in the cover according to an embodiment of the invention.
Figure 5:
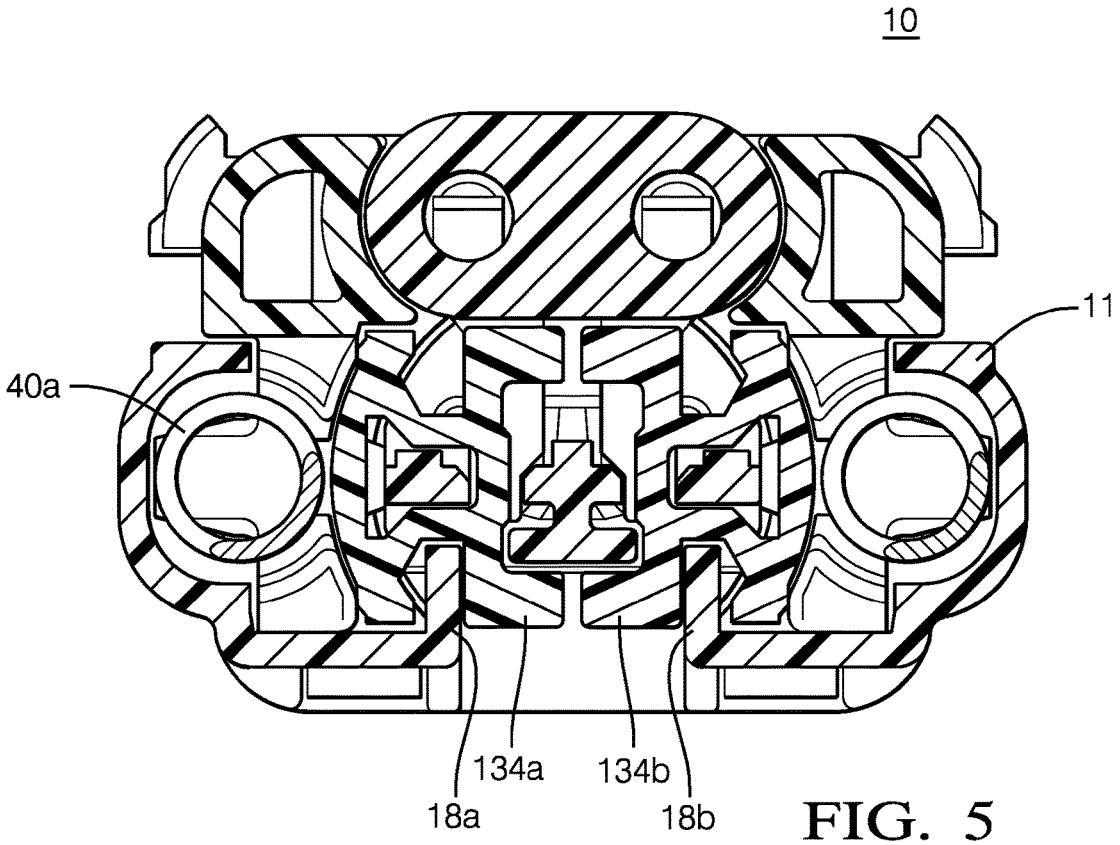
FIG. 5 is a cut away view of the connector of FIG. 1 wherein the cut layer is arranged perpendicular to the mating direction as shown in FIG. 4 (cut along line C1) according to an embodiment of the invention.

FIG. 5 illustrates a cut view of the connector whereby the cut layer is arranged perpendicular to the mating direction. The layer is defined by a cut along the line C1 as shown in FIG. 4. In this view the skilled person sees that the release handles 134*a*, 134*b* are arranged deep in the channel 18. This position of the release handles 134*a*, 134*b* protects the handles from unwanted pull actions.

Figure 6:
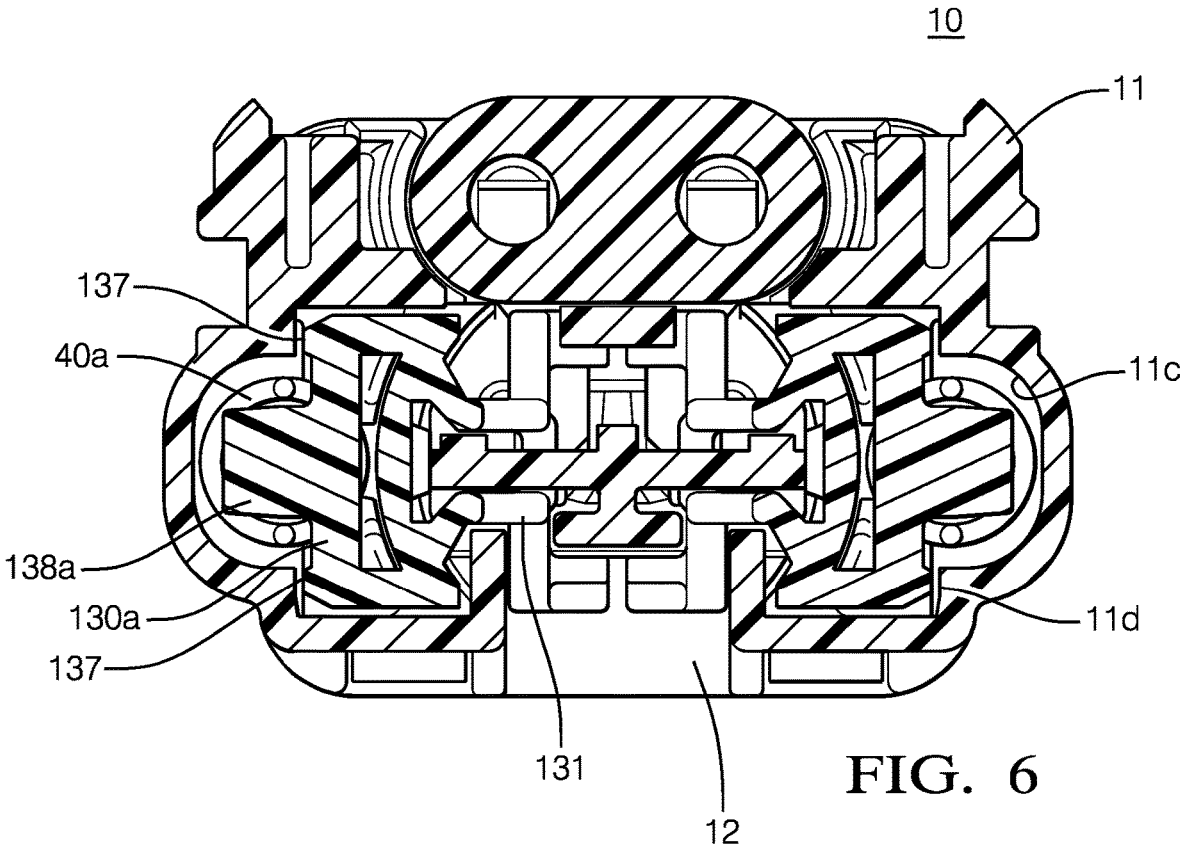
FIG. 6 is a cut away view of the connector of FIG. 1 wherein the cut layer is arranged perpendicular to the mating direction as shown in FIG. 4 (cut along line C2) according to an embodiment of the invention.

FIG. 6 shows a cut view of the connector whereby the cut layer is arranged perpendicular to the mating direction. The layer is defined by a cut along the line C2 as shown in FIG. 4. This view demonstrates the guiding of the locking members 130*a*, 130*b* inside the cover. The locking members 130*a*, 130*b* have guiding protrusions 137 arranged on surfaces that are in contact with guiding surfaces 11*d* on inner surfaces 11*c* of the cover 11. The guiding protrusions 137 are arranged close to the block spring shafts 138*a*, 138*b* of the locking members 130*a*, 130*b* because the spring force pulls on the shafts and presses the guiding protrusions 137 against the guiding surfaces 11*d*.

Figure 7:
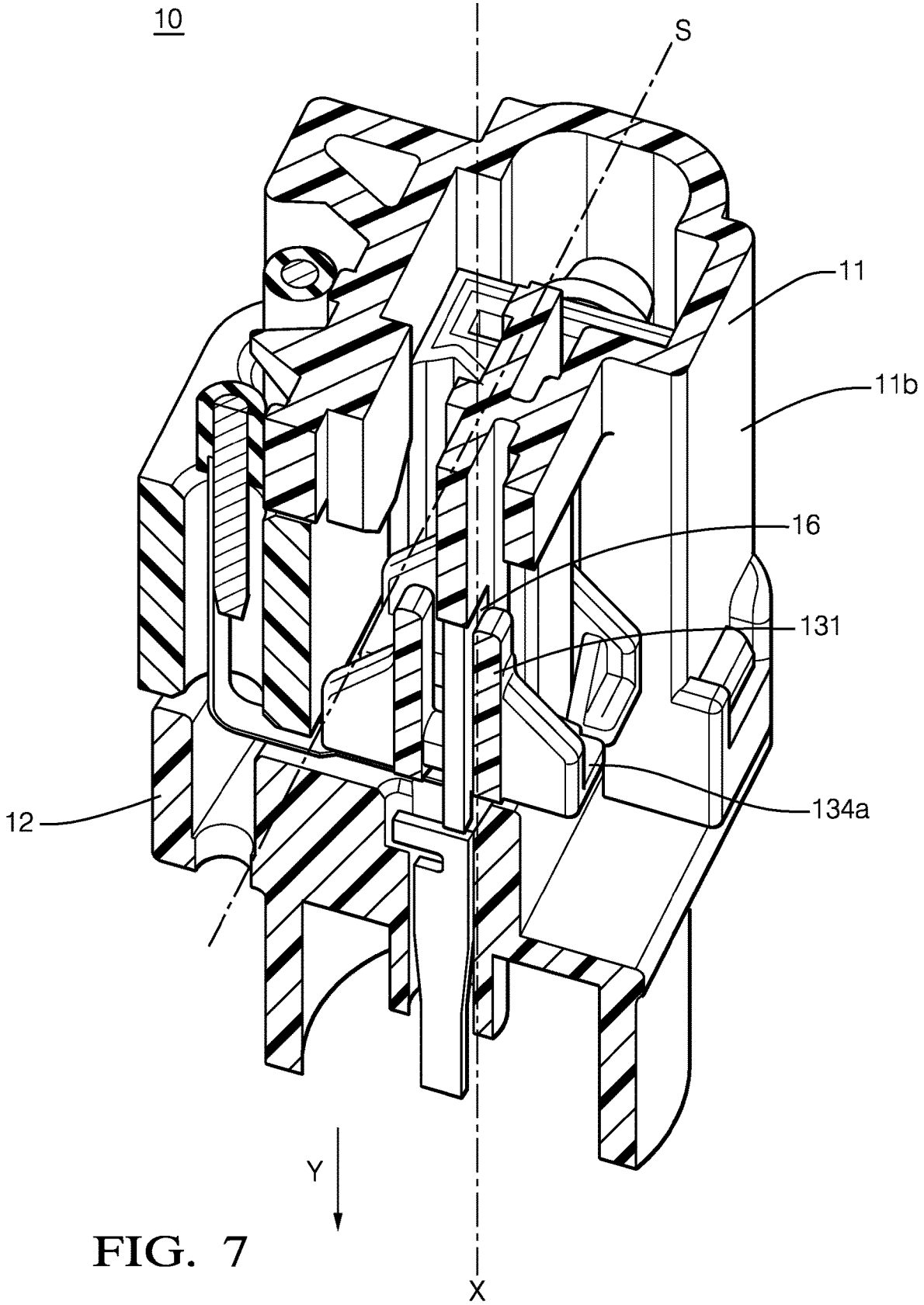
FIG. 7 is a cut away view of the connector of FIG. 1 wherein the cut layer is arranged along the mating axis to show the position of the release handles concerning the opening according to an embodiment of the invention.

FIG. 7 shows a cut view of the connector whereby the cut layer is arranged along the mating axis to show the position of the release handles in relation to the opening. This view explains why the opening 16 is closed by locking members 130*a*, 130*b* if the connector is connected or disconnected. A first wall 131 of the locking members 130*a*, 130*b* is positioned in front of the opening 16. Only in a short moment while connecting or disconnecting the first wall 131 will be moved and uncover the opening 16.

Figure 8:
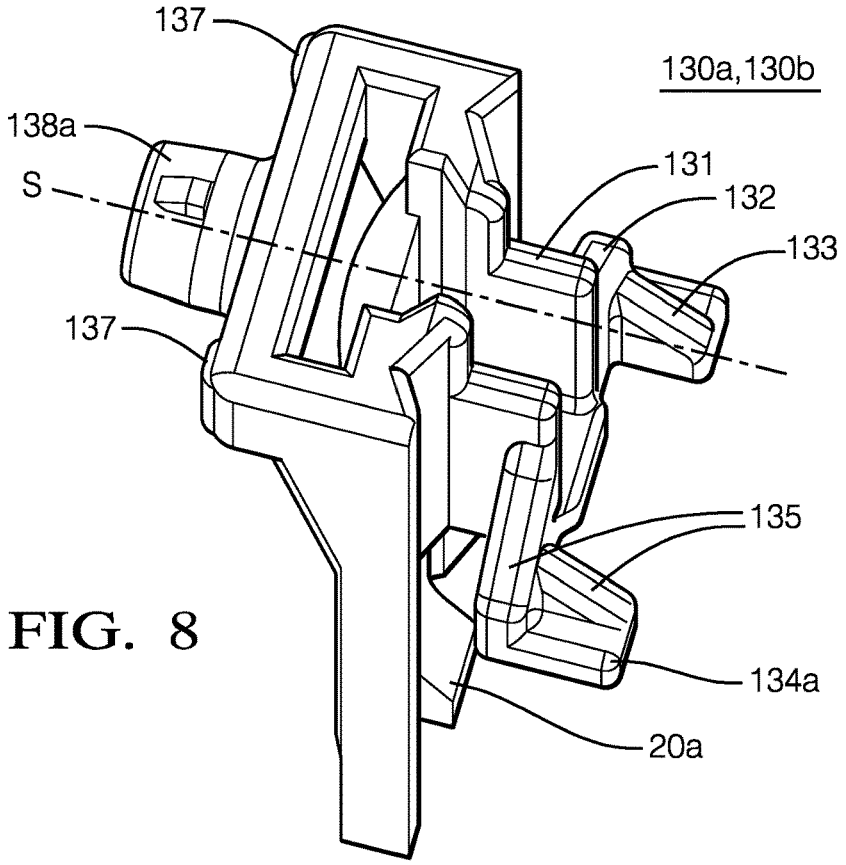
FIG. 8 is perspective view of the locking members according to an embodiment of the invention.

FIG. 8 shows in a perspective view of the locking members 130*a*, 130*b*. The locking members 130*a*, 130*b* have an elongated shape aligned along the mating axis X when assembled in the connector 10. At the end close to the counter connector there is a latching arm 20*a* for purpose of locking the connector 10 to the counter connector. On the opposite end the block spring shafts 138*a*, 138*b* protrude, perpendicular, designed to carry the hooked end of the springs 40*a*, 40*b*. Opposite to the shaft side a structure of walls grows. Beginning with the first wall 131 protruding opposite to the block spring shafts 138*a*, 138*b* direction. Perpendicular to the first wall 131 a second wall 132 extends from the end of the first wall 131. Perpendicular to the second wall 132 a third wall 133 extends from the end of the second wall 132. Portions of the second wall 132 and the third wall 133 defining the release handles 134*a*, 134*b*. Portions of the second wall 132 and the third wall 133 are sloped 135 in relation to the mating axis X.

Figure 9:
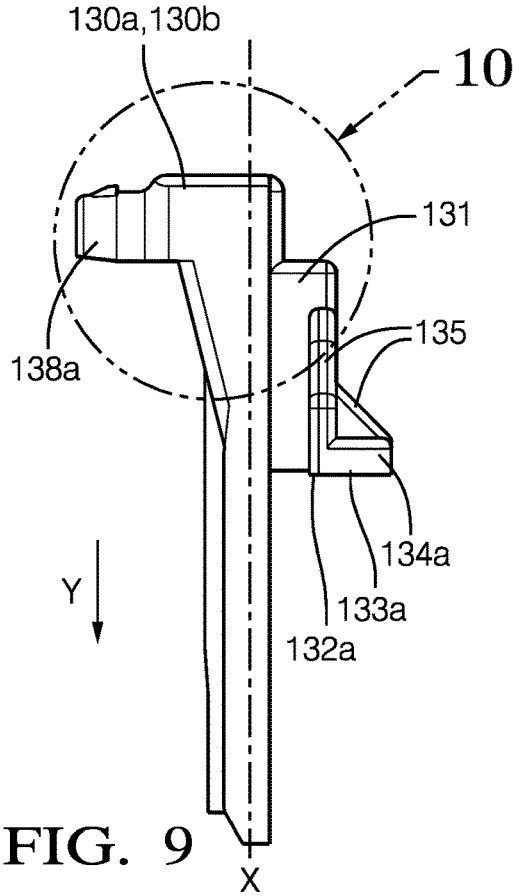
FIG. 9 is a side view of the locking members according to an embodiment of the invention.

FIG. 9 shows a side view of the locking members 130*a*, 130*b*. The above mentioned features may be understood better with help of this view.

Figure 10:
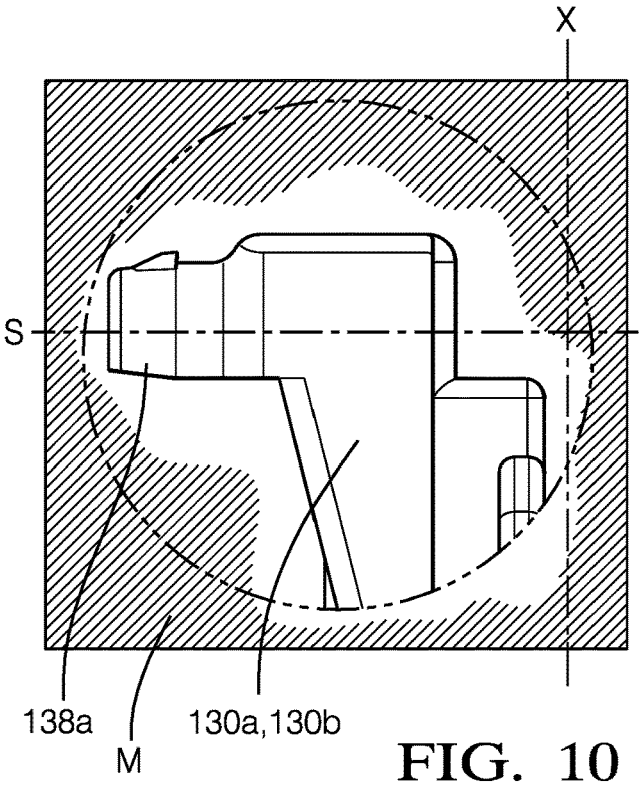
FIG. 10 is a side view of a locking member according to an embodiment of the invention wherein a mirror virtual plane is displayed.

FIG. 10 shows a side view of a locking member whereby a virtual mirror plane is displayed. The purpose of this view is to visualize that the locking members 130*a*, 130*b* have a mirror symmetric shape. The mirror has to be imaged in this figure. A first mirror axis is defined by the center axis of the block spring shafts 138*a*, 138*b* and the second mirror axis is defined by the mating axis X, that is perpendicular to the center axis of the block spring shafts 138*a*, 138*b*.

Figure 11:
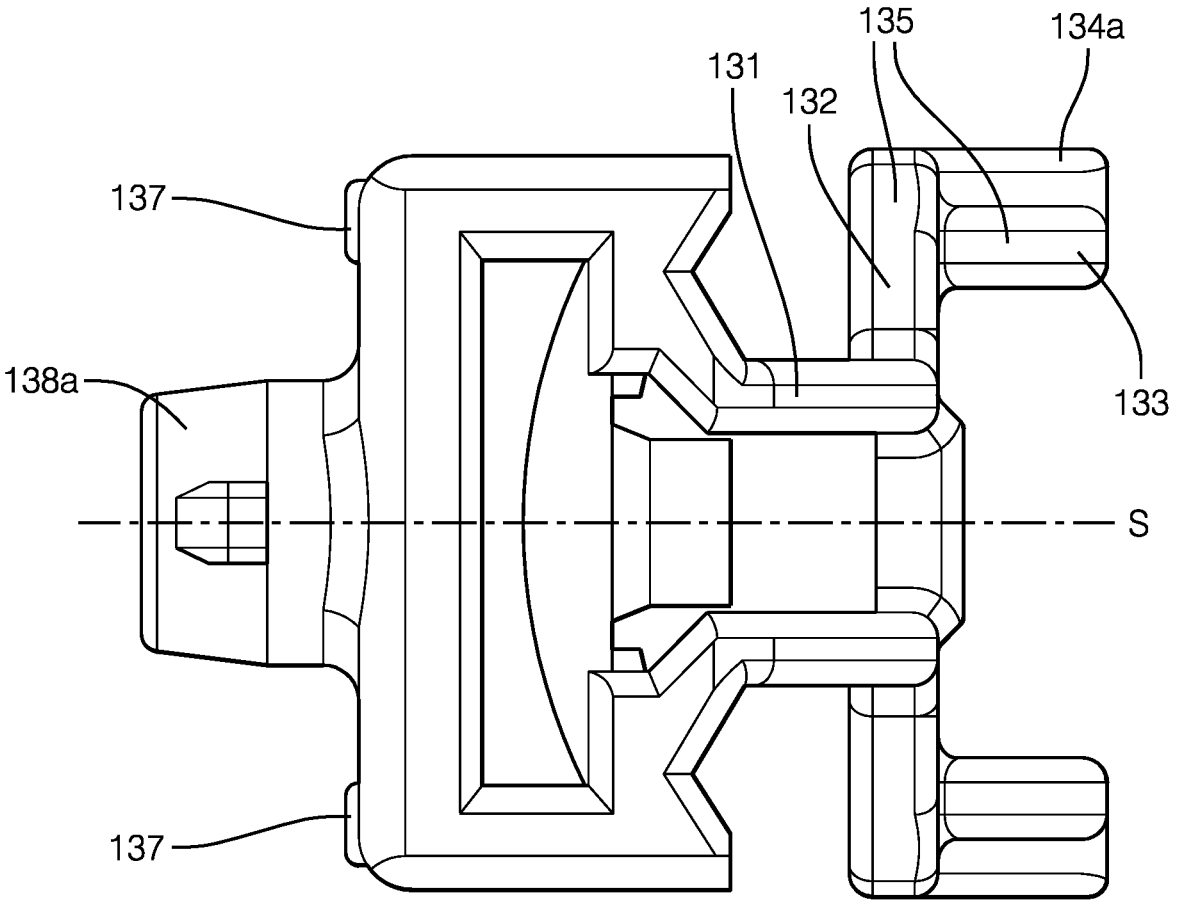
FIG. 11 is a top view of the locking members according to an embodiment of the invention.

FIG. 11 shows a top view of the locking members 130*a*, 130*b*. The above mentioned features may be understood better with help of this view.

In an embodiment, the secondary locking means comprises a blocking arm 31*a* that blocks the primary latching arm 20*a* when in the locked position. When the secondary locking means is moved from the locked position to the open position, the blocking arm 31*a* is correspondingly moved and unlatches or unblocks the primary latching arm 20*a*.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. A connector assembly, comprising:

a connector housing comprising:

a plug-in portion; and two primary latching arms, arranged on opposite sides of the plug-in portion, and secondary locking means attached to the connector housing and arranged relatively movable to the connector housing from an open position to a locked position, wherein the secondary locking means comprises blocking arms that are configured to block a release movement of the two primary latching arms when the secondary locking means is in the locked position, wherein the secondary locking means comprises two separate locking members and each of the two separate locking members is attached to one of the two primary latching arms and configured to block the release movement of the respective latching arm, wherein each of the two separate locking members is independently moveable between the open position and the locked position, wherein each locking member comprises actuating release handles to allow an un-latching of the two primary latching arms, wherein the release handles are arranged adjacent to each other, wherein the two separate locking members have an elongated body extending along the mating axis, wherein the two separate locking members comprise a block spring shaft that protrudes perpendicular to the mating axis, wherein a center axis of the block spring shaft and the mating axis of the connector assembly define a mirror plane and wherein each locking member is symmetrical with respect to the mirror plane, wherein a first wall extends perpendicular from the elongated body along the mating axis, and wherein a second wall extends perpendicular and along the mating axis from a portion of a free end of the first wall.

2. The connector assembly according to claim 1, wherein a third wall extends perpendicular and along the mating axis from a portion of a free end of the second wall.

3. The connector assembly according to claim 2, wherein the first wall or the second wall comprises sloped portions that are sloped relative to the mating axis, wherein the walls increase in size along the mating direction.

4. The connector assembly according to claim 2, wherein a free end of the second wall or a free end of the third wall facing toward a counter connector defines the actuating release handles.

5. The connector assembly according to claim 1, further comprising a cover at least partly surrounding the secondary locking means along a mating axis, wherein the cover has at least one elongated opening in a mating direction and wherein a portion of the secondary locking means closes the at least one elongated opening in the open position and the locked position.

6. The connector assembly according to claim 5, wherein a length of the first wall along the mating axis is configured to enclose the at least one elongated opening.

7. The connector assembly according to claim 1, wherein the cover comprises an outer surface that defines a channel extending along the mating axis and wherein the at least one elongated opening is located in the channel.

8. The connector assembly according to claim 7, wherein the release handles are fully received in the channel.

9. The connector assembly according to claim 7, wherein the two separate locking members comprise at least two guiding protrusions and the cover comprises guiding areas on inner walls of the cover to guide the two separate locking members while mating to a counter connector.

10. The connector assembly according to claim 1, wherein the elongated opening extends contrary to the mating direction from an end of the cover that is adjacent to the plug-in portion of the connector assembly.

11. The connector assembly according to claim 1, wherein the two separate locking members are identical to each other.

12. The connector assembly according to claim 1, wherein the two separate locking members have an elongated body extending along the mating axis.

* * * * *